United States Patent [19]

Sanz et al.

[11] Patent Number: 4,838,431

[45] Date of Patent: Jun. 13, 1989

[54] PACK, FOR FOOD PRODUCTS IN PARTICULAR

[75] Inventors: Erich Sanz, Ronsberg; Erhard Heinz, Kempten, both of Fed. Rep. of Germany

[73] Assignee: Unilever Patent Holdings B.V., Rotterdam, Netherlands

[21] Appl. No.: 138,196

[22] PCT Filed: Jul. 25, 1987

[86] PCT No.: PCT/EP87/00402

§ 371 Date: Dec. 4, 1987

§ 102(e) Date: Dec. 4, 1987

[87] PCT Pub. No.: WO88/00909

PCT Pub. Date: Feb. 11, 1988

[30] Foreign Application Priority Data

Jul. 25, 1986 [DE] Fed. Rep. of Germany ..... 3625220

[51] Int. Cl.[4] ..... B65D 3/26

[52] U.S. Cl. ..... 206/631; 229/1.5 B; 229/48 T

[58] Field of Search ..... 229/1.5 B, 1.5 H, DIG. 7, 229/125.35, 48 T; 206/484, 484.2, 631, 631.3

[56] References Cited

U.S. PATENT DOCUMENTS

| | | | |
|---|---|---|---|
| 1,964,238 | 6/1934 | Wood | 229/1.5 B |
| 2,035,631 | 3/1936 | Wood | 229/1.5 B |
| 2,125,069 | 7/1938 | Fenner | 229/1.5 B |
| 2,150,207 | 3/1939 | Currie | 206/631 |
| 2,966,292 | 12/1960 | Saidel | 229/1.5 B |
| 3,217,871 | 11/1965 | Lee | 206/484 |
| 3,487,443 | 12/1969 | Wise et al. | 229/1.5 B |
| 3,675,015 | 7/1972 | Geib | 206/631.3 |
| 4,684,058 | 8/1987 | Weber | 206/631 |

FOREIGN PATENT DOCUMENTS 2658631 6/1978 Fed. Rep. of Germany .

OTHER PUBLICATIONS

Distribution Packaging, Published by Robert E. Krieger Publishing Co., p. 362 (1977).

*Primary Examiner*—Stephen Marcus
*Assistant Examiner*—Gary E. Elkins
*Attorney, Agent, or Firm*—Cushman, Darby & Cushman

[57] ABSTRACT

A pack with at least one longitudinal seam in the form of a glued seam, at least part of which can be pulled apart to open the pack. This glued seam is interrupted by sections with diminished adhesive power. To this end, an agent in contact with which the gluing agent, such as hotmelt, has no or only very little adhesive power, is applied in the area of the glued seam.

2 Claims, 1 Drawing Sheet

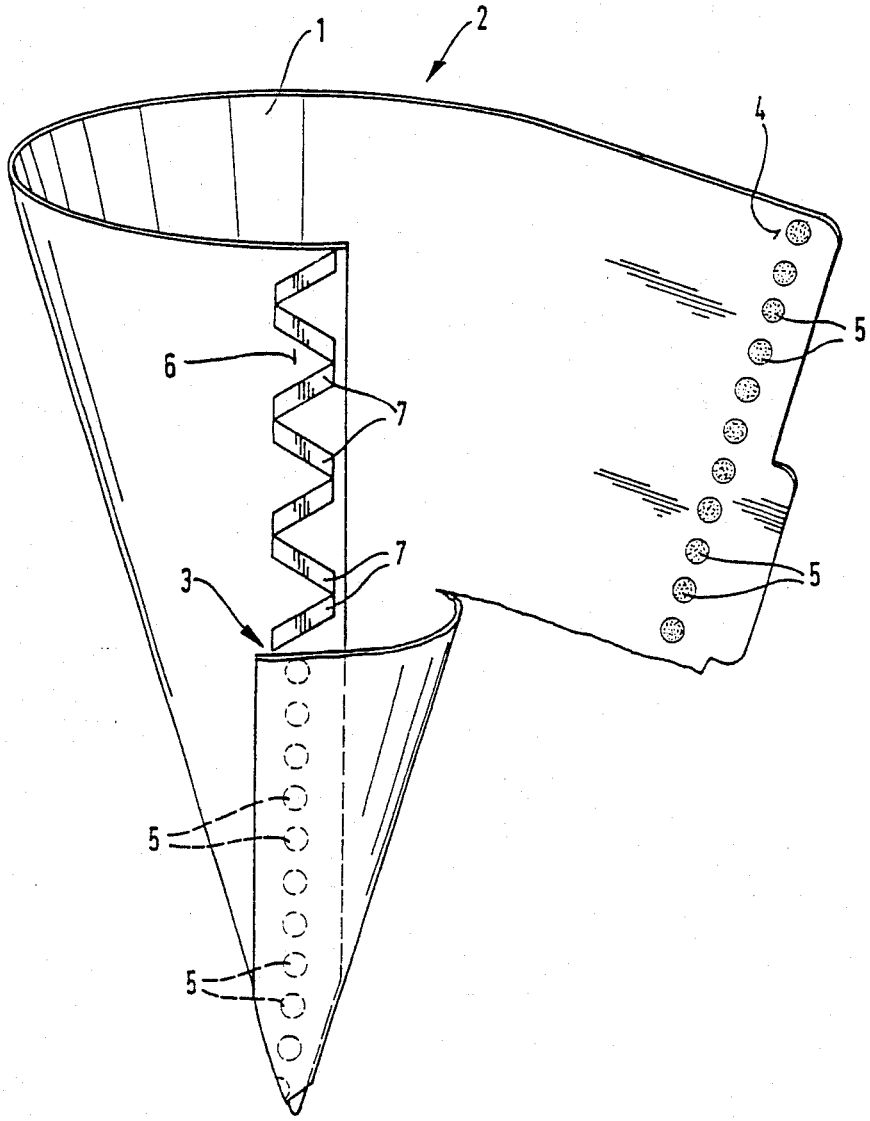
1
2
4
5
6
7
7
3
5
5
5

PACK, FOR FOOD PRODUCTS IN PARTICULAR

BACKGROUND OF THE INVENTION

The invention relates to a pack, for food products in particular, with at least one longitudinal seam in the form of a glued seam, at least part of which can be pulled apart to open the pack.

Such packs are regularly expected to fulfil the conflicting requirements that the glued seam on the one hand has to provide a reliable closure but on the other hand is supposed to be easy to pull apart to open the pack.

SUMMARY OF THE INVENTION

The purpose of the invention is therefore to create a pack that meets both requirements.

The way the invention achieves this purpose is to interrupt the glued seam by sections with diminished adhesive power.

Reliable closure of the pack is achieved in the areas with full adhesive power, while pack opening is facilitated by the interruptions.

It is very advantageous if in accordance with the invention hotmelt is provided as the gluing agent and if an agent is applied to sections of one of the two sides of the glued seam, to which the hotmelt only adheres very slightly, if at all. This agent is applied as a final layer when the packaging material is printed, so that an additional operation is not needed.

It has proved to be very advantageous if in accordance with this invention the agent that diminishes the adhesive power is applied in a zig-zag pattern.

In a further embodiment of the invention the hotmelt can also be applied in spots.

It has also proved to be a very good solution if the pack is designed to be a cone sleeve for ice cream or a similar product and the longitudinal seam is only provided with the sections to diminish the adhesive power at its top end, i.e. towards the opening of the pack.

When such a cone sleeve is opened, it is practical if only the top section is removed and the lower section remains in place for the consumer to hold until most of the contents have been eaten. This assignment is carried out extremely effectively with the present invention.

BRIEF DESCRIPTION OF THE INVENTION

The drawing shows one embodiment of the invention, in this case a pack designed as a cone sleeve which has been torn open to some extent.

DETAILED DESCRIPTION OF THE INVENTION

1 is a blank from which a pack 2 in the shape of a cone sleeve is wound, into which an ice cream cone (not illustrated) can be inserted.

The pack is formed along a longitudinal seam 3, for the production of which spots of hotmelt 5 are applied to the inside 4 of the longitudinal seam area of blank 1. This hotmelt can, however, also be applied in a continuous strip.

An agent 7, to which the hotmelt 5 only adheres very slightly, is applied to the longitudinal seam area of the outside 6. This agent 7 is applied in a zig-zag pattern, although it can also be applied in a different pattern that diminishes the adhesion of the hotmelt.

We claim:

1. A pack for food products including a material having a longitudinal seam defined by two edges of said material positioned to overlap each other with engaging portions, one of said portions being disposed under the other of said portions, one of said portions having a material coated thereon in a zig-zag pattern and the other of said portion having a hotmelt adhesive applied thereto in the form of a plurality of spaced apart spots to thereby provide spaces without an adhesive to thereby diminish the adhesive power of said other of said portions, said material being of a type that diminishes adhesion with said hotmelt adhesive.

2. Pack according to claim 1, wherein the pack is in the form of a cone sleeve for ice cream and the seam has a first section for initiating opening and a second section with said other portion of said first section having said spaced spots.

* * * * *